US006390067B1

(12) United States Patent
Haltiner, Jr. et al.

(10) Patent No.: US 6,390,067 B1
(45) Date of Patent: May 21, 2002

(54) VALVE SEAT RETAINER FOR A FUEL INJECTOR

(75) Inventors: Karl Jacob Haltiner, Jr., Fairport; Robert B. Perry, Leicester, both of NY (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/636,132

(22) Filed: Aug. 10, 2000

(51) Int. Cl.[7] ..... F02M 33/06
(52) U.S. Cl. ..... 123/470; 239/533.12
(58) Field of Search ..... 239/533.12, 585.1–585.5, 239/900; 251/129.14, 361

(56) References Cited

U.S. PATENT DOCUMENTS 2,874,000 A * 2/1959 Nystrom
4,603,838 A * 8/1986 Gotch ..... 251/361
4,827,968 A * 5/1989 Brown ..... 137/270
5,297,580 A * 3/1994 Thurman ..... 251/364
5,381,965 A * 1/1995 Chabon et al. ..... 239/585.1
5,549,274 A * 8/1996 Buchanan ..... 251/129.14
5,636,827 A * 6/1997 Kilgore et al. ..... 239/585.5
5,662,277 A * 9/1997 Taubitz et al. ..... 239/533.12
5,823,444 A * 10/1998 Reiter et al. ..... 239/533.12
5,860,601 A * 1/1999 Egizi ..... 239/533.12
6,015,103 A * 1/2000 Kotkowicz ..... 239/585.4
6,027,050 A * 2/2000 Rembold et al. ..... 239/585.5
6,089,473 A * 7/2000 Keim ..... 239/533.123
6,105,884 A * 8/2000 Molnar et al. ..... 239/585.1
6,170,763 B1 * 1/2001 Fuchs et al. ..... 239/533.12
6,264,112 B1 * 7/2001 Landshoot et al. ..... 239/585.1

* cited by examiner

*Primary Examiner*—Thomas N. Moulis
(74) *Attorney, Agent, or Firm*—John Van Ophem

(57) ABSTRACT

A fuel injector is provided for use in an internal combustion engine. The fuel injector includes an injector body having an axially extending fuel passage for fuel flow, an injection valve movable in the passage for controlling fuel flow therein, a valve seat adjustably positioned into an outlet end of the fuel passage, and a valve seat retainer for applying an axial load onto the valve seat and securely attaching the valve seat into the fuel passage of the injector body.

22 Claims, 4 Drawing Sheets

VALVE SEAT RETAINER FOR A FUEL INJECTOR

TECHNICAL FIELD

The present invention relates generally to fuel injectors for use in an internal combustion engine and, more particularly, to a valve seat retainer for securely attaching the valve seat into the fuel passage of the fuel injector.

BACKGROUND OF THE INVENTION

It is well known in the automotive engine art to provide solenoid actuated fuel injectors for controlling the injection of fuel into the cylinders of an internal combustion engine. Fuel injectors generally include a body having internal and external components which are assembled together to provide an internal fuel passage for fuel flow therein. An injector valve is actuated within the fuel passage to control fuel flow, such that the injector valve axially separates from the a valve seat in an open position and sealingly engages the valve seat in a closed position.

In constructing the fuel injector, the valve seat and associated components are adjustably positioned in an outlet end of the fuel passage. A clamp load is then applied to the valve seat assembly and it is securely attached into the fuel passage of the injector. It is imperative that the magnitude and direction of the clamp load be accurately controlled in order to minimize distortion of the valve seat and to keep it precisely in position over the life of the fuel injector.

Two techniques are typically used to attached the valve seat into the fuel passage. First, a weld is placed between the valve seat and the inner surface of the fuel passage. However, the welding process introduces heat between the components which may distort them, thereby causing fuel leaks. Second, an extending flange portion of the injector body may be crimped over the end of the fuel passage, thereby securing the valve seat within the fuel passage of the injector. In this case, the crimped flange portion of the body applies the clamp load to the valve seat. Since the crimped flange portion may experience some spring back, the magnitude and direction of the clamp load is unknown.

Therefore, it is desirable to provide a valve seat retainer for securely attaching the valve seat into the fuel passage of the fuel injector, such that the magnitude and direction of the clamp load is accurately known and maintained over the life of the fuel injector. It is also desirable that the valve seat retainer be designed to flex under load in order to maintain the clamp load during and after the assembly process. The valve seat retainer may also serve as a fuel director retainer for securely attaching the fuel director to the valve seat.

SUMMARY OF THE INVENTION

In accordance with the present invention, a fuel injector is provided for use in an internal combustion engine. The fuel injector includes an injector body having an axially extending fuel passage for fuel flow therein, an injection valve movable in the passage for controlling fuel flow, a valve seat adjustably positioned into an outlet end of the fuel passage, and a valve seat retainer for applying an axial load onto the valve seat and securely attaching the valve seat into the fuel passage of the injector body.

For a more complete understanding of the invention, its objects and advantages, refer to the following specification and to the accompanying drawings.

DESCRIPTION OF THE PREFERRED EMBODIMENT

Figure 1:
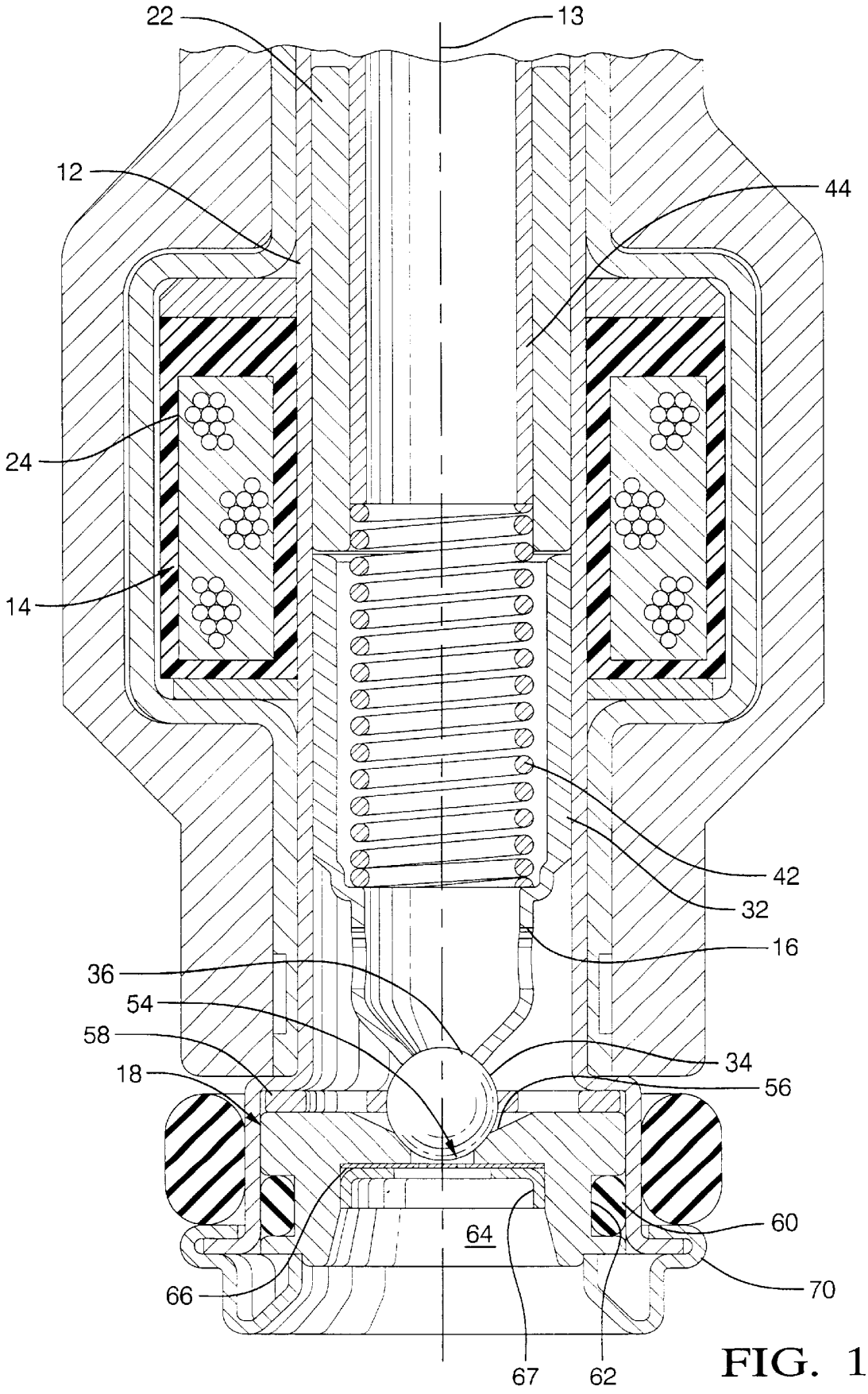
FIG. 1 is a fragmentary cross-sectional view of an exemplary fuel injector embodying features of the present invention.

A solenoid actuated fuel injector 10 embodying features of the present invention is depicted in FIG. 1. The fuel injector 10 generally includes an injector body 12, a solenoid actuator assembly 14, a valve assembly 16 and a valve seat assembly 18. While the following description is provided with reference to a particular fuel injector, it is readily understood that the broader aspects of the present invention are applicable to other types of and configurations for fuel injectors.

In the illustrated construction, the injector body 12 is a hollow, cylindrical configuration defining a central axis 13 and having an axially extending fuel passage therethough. The solenoid actuator assembly 14 is disposed within the upper portion of the injector body 12. The solenoid assembly 14 is comprised of a magnetic pole piece 22 fixed within the fuel passage of the injector body 12 and a solenoid actuator 24 extending around the magnetic pole piece 22.

The valve assembly 16 includes a valve element 30 and a rod-shaped armature 32 that extends axially within the lower portion of the injector body 12. A spherical ball 34 positioned within a circular socket 36 of the armature 32 may serve as the valve element 30. The radius of the valve element 30 is selected for seating engagement with the valve seat assembly 18. It is envisioned that other embodiments of the valve assembly are within the scope of the present invention.

The valve element 30 is normally biased into a closed, seated engagement with the valve seat assembly 18 by a biasing member such as a coil spring 42. The coil spring 42 is positioned between a calibration sleeve 44 and the armature 32 of the valve assembly 16 as shown in FIG. 1. In this way, the position of the calibration sleeve 44 within the pole piece 22 adjusts the spring force exerted on the valve assembly 16.

The valve seat assembly 18 is primarily comprised of a valve seat 52 which is fixed at an outlet end of the fuel passage. The valve seat 52 provides a central discharge opening 54 to allow fuel flow through the injector 10. The central discharge opening 54 is further defined as having a conical surface 56 which engages the spherical ball 34 of the valve assembly 16. The valve seat assembly may optionally include a valve guide 58 that guides that valve assembly 16 into contact with the valve seat 52. The valve guide 58 is positioned between the valve seat 52 and the flange-like surface formed by an expanded diameter portion of the injector body 12. The valve guide 58 also include openings which allow fuel flow though the valve guide 58. An outer seal ring 60 may be captured in an outer groove 62 of the valve seat 60, thereby preventing fuel from leaking around the valve seat and bypassing the discharge opening.

Furthermore, the central discharge opening 54 connects with a circular recess 64 on the underside of the valve seat 52. A fuel spray director plate 66 may be press fitted or otherwise retained in the circular recess 64 of the valve seat 52. A fuel director retainer 67 may optionally be used to secure the director plate 66 into the recess of the valve seat 52. Fuel passing through the central discharge opening 54 is delivered to the director plate 66, where it is distributed across a plurality of fuel directing openings 68 extending therethrough. The fuel directing openings 68 are oriented to generate a desired spray configuration in the fuel discharged from the injector.

In operation, energizing of the solenoid actuator 24 draws the valve assembly 16 upward into engagement with the pole piece 22, thereby axially separating the valve assembly 16 from the central discharge opening 54 in the valve seat 52. Thus, fuel is allowed to flow through the injector into an associated intake manifold or inlet port of an internal combustion engine (not shown). Upon de-energization of the solenoid actuator 24, the coil spring 42 biases the valve assembly 16 back towards the valve seat 52, thereby closing the injector. Other types of actuators as well as modes of operation for the injector are within the broader aspects of the present invention.

In accordance with the present invention, a valve seat retainer 70 is used to securely attach the valve seat assembly 18 into the outlet end of the injector body 12. Generally, the valve seat retainer provides a means for applying an axial load onto a bottom surface of the valve seat and a means for coupling the valve seat to the injector body. While the following description is provided with reference to specific constructions for the valve seat retainer, it is readily understood that other configurations are within the scope of the present invention.

Figure 2A:
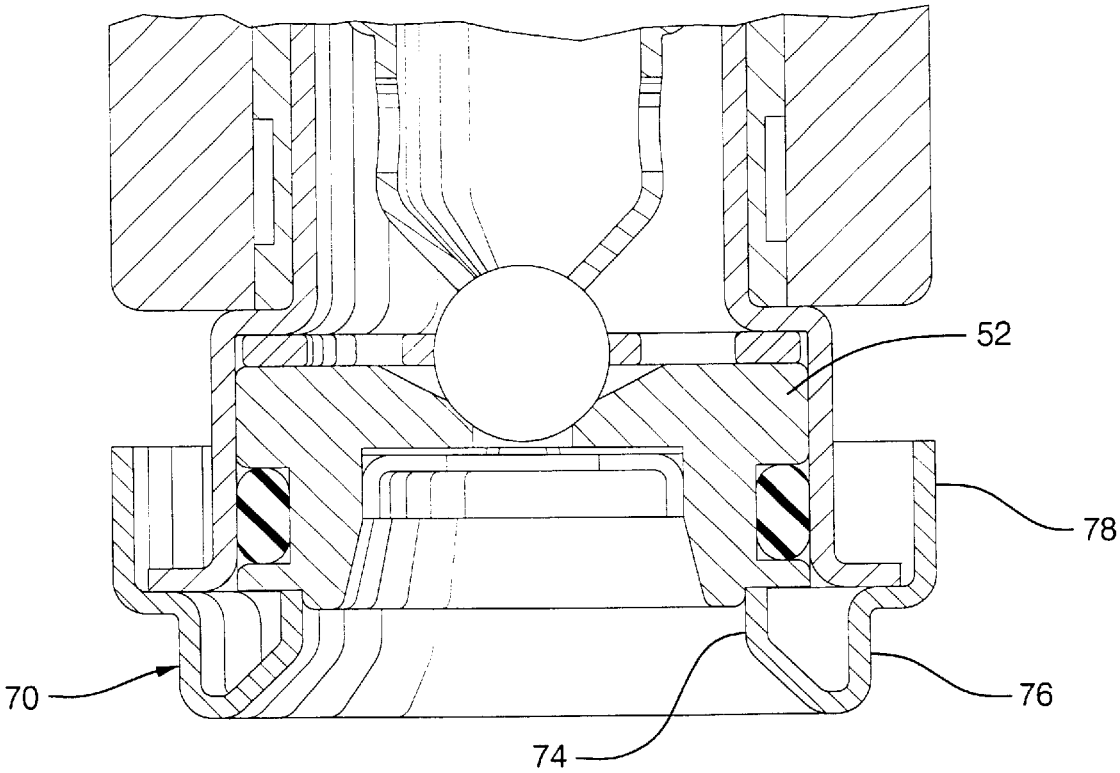
FIGS. 2A and 2B are fragmentary cross-sectional views of an exemplary fuel injector illustrating a first preferred embodiment of a valve seat retainer in accordance with the present invention.
Figure 2B:
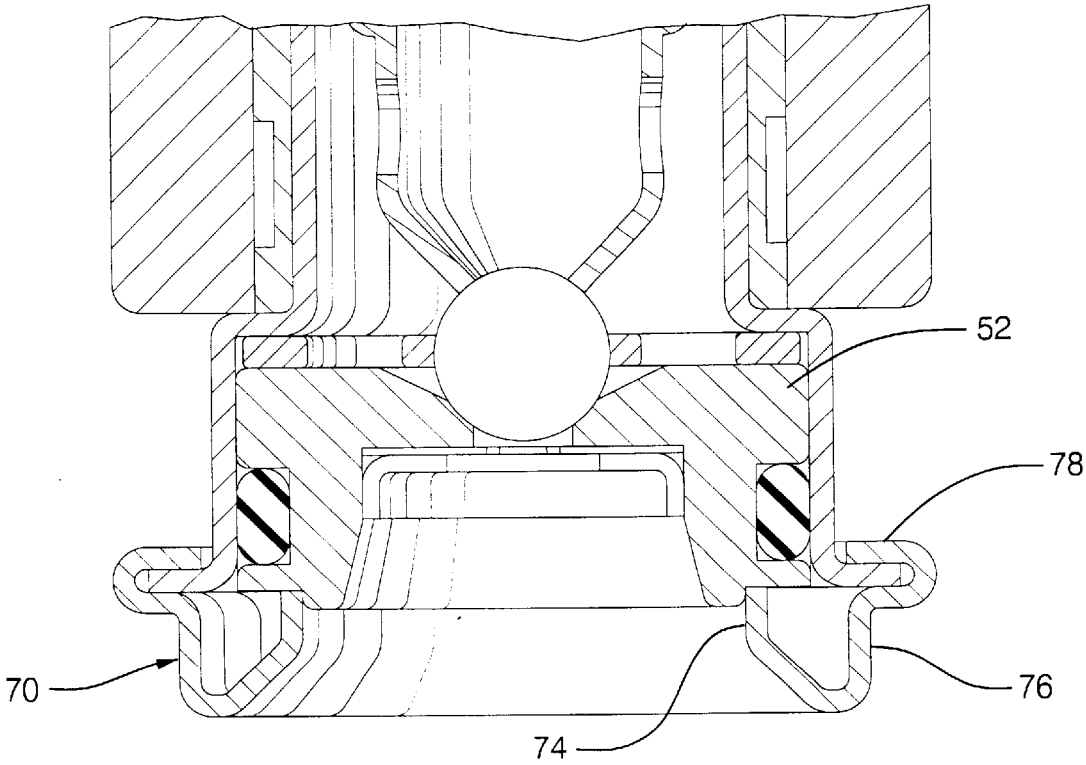

A first preferred embodiment of a valve seat retainer 72 is shown in FIGS. 2A and 2B. The valve seat retainer 72 is defined as a circular channel member having an inner wall 74 and an outer wall 76, where the outer wall 76 further includes an offshoot 78 which protrudes outward and axially upward above the inner wall 74. During assembly, the valve seat retainer 72 is pressed against the valve seat 52, such that the top of the inner wall 74 engages a bottom surface of the valve seat 52. The valve seat retainer 72 is further displaced until it contacts the bottom of the injector body 12. This flexes or deflects the inner wall 74, thereby applying an axial force onto the valve seat 52. In this way, the direction and magnitude of the clamp load on the valve seat 52 are accurately controlled. In this embodiment, the bottom surface of the valve seat 52 is positioned flush with the bottom of the injector body 12. As best seen in FIG. 2B, the valve seat 52 is then retained in position by crimping the offshoot 78 of the valve seat retainer 72 over an outwardly extending flange 80 on the lower portion of the injector body 12.

Figure 3:
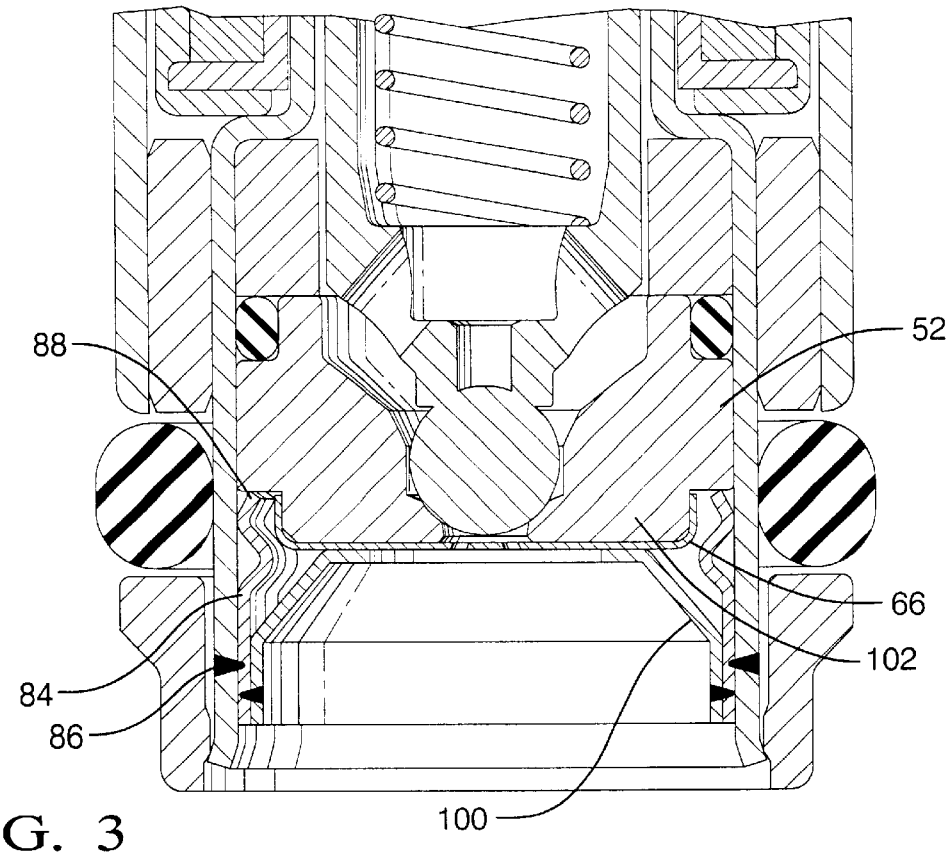
FIG. 3 is a fragmentary cross-sectional view of an exemplary fuel injector illustrating a second preferred embodiment of a valve seat retainer in accordance with the present invention.

A second preferred embodiment of a valve seat retainer 82 is illustrated in FIG. 3. When the valve seat 52 is positioned into the outlet end of the fuel passage, the lower expanded diameter portion of the injector body 12 extends beyond the bottom surface of the valve seat 52. In this case, the valve seat retainer 82 is a hollow cylinder 84 that is inserted into the lower expanded diameter portion of the injector body 12. The top surface of the cylinder is pressed against the bottom surface of the valve seat 52, thereby applying the clamp load onto the valve seat 52. The valve seat retainer 82 is then held in place by a weld 86 positioned between the outer surface of the cylinder and the inner surface of the injector body. In order to maintain the clamp load throughout the assembly process, a portion of the valve seat retainer 82 is designed to deflect under load. In particular, the cylinder includes a corrugated area 88 which deflects under load.

Figure 4:
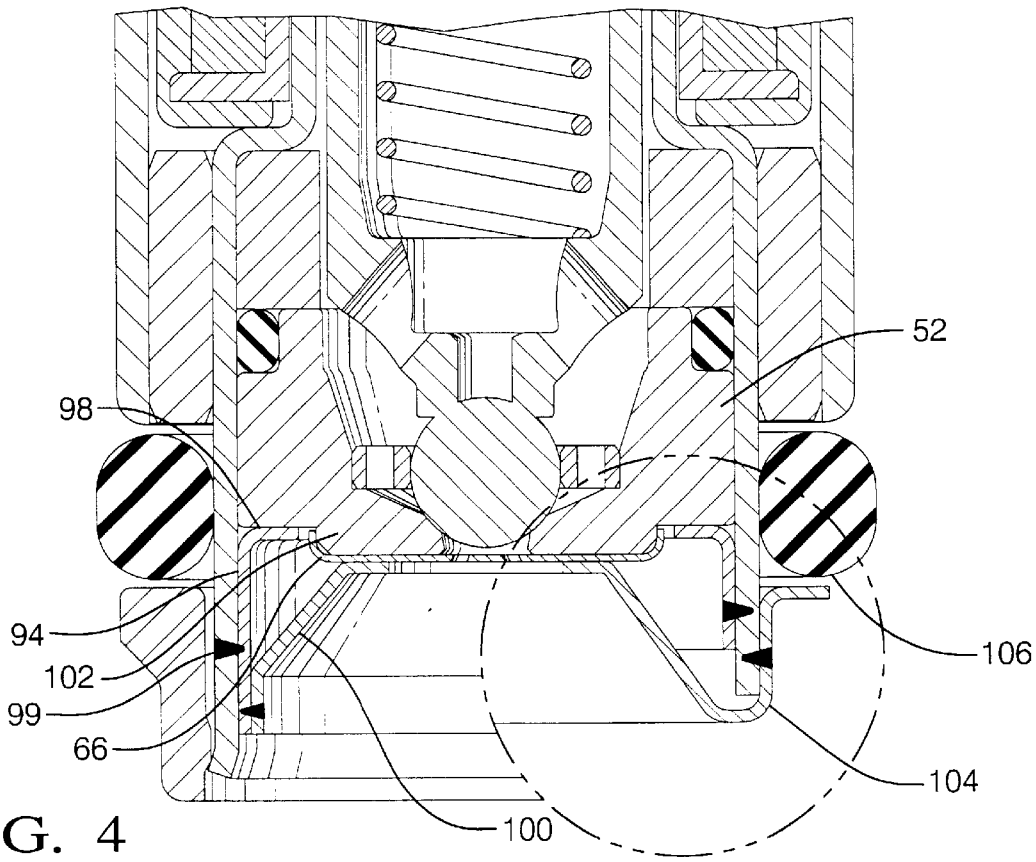
FIG. 4 is a fragmentary cross-sectional view of an exemplary fuel injector illustrating a third preferred embodiment of a valve seat retainer in accordance with the present invention.

A third preferred embodiment of a valve seat retainer 92 is illustrated in FIG. 4. The valve seat retainer 92 is an inverted cup-shaped member 94 that is inserted into the lower expanded diameter portion of the injector body 12. The cup-shaped member includes an opening 96 through the top of the cup-shaped member, thereby forming a radially inwardly extending lip 98. To apply the clamp load to the valve seat 52, the lip 98 of the cup-shaped member 94 is pressed against the bottom surface of the valve seat 52. Again, the valve seat retainer 92 is then held in place by a weld 99 positioned between the outer surface of the retainer and the inner surface of the injector body. In this case, the lip 98 is designed to deflect under load in order to maintain the clamp load during and after the assembly process.

In either of these last two embodiments, an optional director retainer 100 may be used to securely attach the fuel director plate 66 to the valve seat 52. The fuel director plate 66 is adapted to engage a protruding area 102 along the bottom surface of the valve seat 52. In the event the fuel director is not press fit or otherwise retained on the protruding area 102, a unshaped director retainer 100 may be used to retain the fuel director plate 66. The director retainer 100 is pressed against the director plate 66 and then spot welded to the inner surface of the valve seat retainer. An inner lip 103 of the director retainer 100 is again designed to deflect under load in order to maintain the clamp load during and after the assembly process. As best seen in FIG. 4, the director retainer 100 may farther include a flange portion 104 that extends around the bottom end of the injector body 12. In this way, the director retainer also engages an annular O-ring seal 106 positioned between the injector body and an associated inlet port of an internal combustion engine (not shown).

Figure 5:
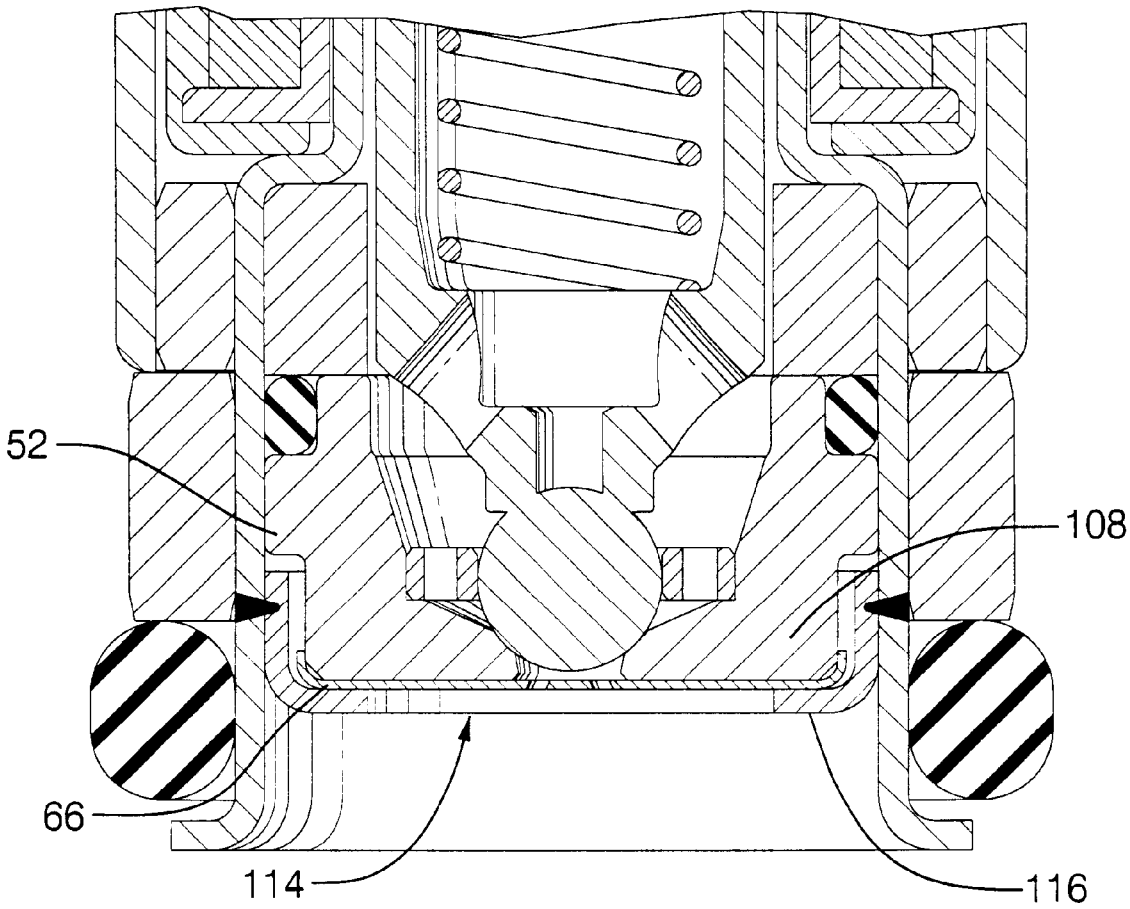
FIG. 5 is a fragmentary cross-sectional view of an exemplary fuel injector illustrating a fourth preferred embodiment of a valve seat retainer in accordance with the present invention.

Referring to FIG. 5, a fourth preferred embodiment of a valve seat retainer 110 doubles as the director retainer. After the valve seat 52 is positioned in the injector body 12, the fuel director plate 66 is placed over the protruding area 102 of the valve seat 52. In this instance, the valve seat retainer 94 is an upright cup-shaped member 112 with an opening 114 in the bottom of the cup-shaped member, such that a lip 116 is formed around the opening 114. The valve seat retainer 110 is then positioned over the protruding area 102, such that lip 116 of the retainer 110 engages at least a portion of the fuel director plate 66. In this way, the fuel director plate 66 is held in place by the valve seat retainer 110. In order to apply a clamp load, the valve seat retainer 110 is pressed against the fuel director plate 66 which is turn pushes against the bottom surface of the valve seat. Again, the lip 116 is designed to deflect under load in order to maintain the clamp load during and after the assembly process. Lastly, the valve seat retainer 110 is securely attached by a weld 118 positioned between the outer surface of the retainer and the inner surface of the injector body.

While the above description constitutes the preferred embodiment of the invention, it will be appreciated that the invention is susceptible to modification, variation, and change without departing from the proper scope or fair meaning of the accompanying claims.

What is claimed is:

1. A fuel injector for use in an internal combustion engine, the fuel injector having an injector body with an axially extending fuel passage for fuel flow therein, an injection valve movable in the passage for controlling fuel flow, and a valve seat adjustably positioned into an outlet end of the fuel passage, said fuel injector comprising:

a valve seat retainer engaging the valve seat, said valve seat retainer crimped into engagement with said injector body to thereby retain said valve seat in position relative to said injector body.

2. A fuel injector for use in an internal combustion engine, the fuel injector having an injector body with an axially extending fuel passage for fuel flow therein, an injection valve movable in the passage for controlling fuel flow, and a valve seat adjustably positioned into an outlet end of the fuel passage, the improvement comprising:

a valve seat retainer for applying an axial load onto the valve seat and attaching the valve seat into the fuel passage of the injector body, the valve seat retainer being defined as a circular channel member having an inner wall and an outer wall, where the outer wall further includes an offshoot which protrudes outward and axially upward above the inner wall.

3. The fuel injector of claim 2 wherein the valve seat retainer is pressed against the valve seat, such that the top of the inner wall engages a bottom surface of the valve seat, thereby applying an axial load onto the valve seat, and is retained in position by crimping the offshoot of the valve seat retainer over an outwardly extending flange of the injector body.

4. The fuel injector of claim 3 wherein the inner wall deflects under a predetermined axial force, thereby maintaining the axial load on the valve seat.

5. The fuel injector of claim 2, wherein the valve seat retainer is a hollow cylinder pressed against a bottom surface of the valve seat, thereby applying an axial load onto the valve seat, and attached to the injector body by a weld positioned between the outer surface of the cylinder and the inner surface of the injector body.

6. The fuel injector of claim 5 wherein an upper corrugated portion of the cylinder deflects under a predetermined axial force, thereby maintaining the axial load on the valve seat.

7. The fuel injector of claim 2, wherein the valve seat retainer is a cup-shaped member, having an opening therethrough, pressed against a bottom surface of the valve seat, thereby applying an axial load onto the valve seat, and attached to the injector body by a weld positioned between the outer surface of the cup-shaped member and the inner surface of the injector body.

8. The fuel injector of claim 7 wherein the opening in the bottom surface of the cup-shaped member forms a radially inwardly extending lip, such that the lip deflects under a predetermined axial force, thereby maintaining the axial load on the valve seat.

9. A fuel injector for use in an internal combustion engine, comprising:

an injector body having an axially extending fuel passage for fuel flow therein;

an injection valve movable in the passage for controlling fuel flow;

a valve seat adjustably positioned into an outlet end of the fuel passage; and a valve seat retainer engaging the valve seat and being attached to said injector body.

10. A fuel injector for use in an internal combustion engine, comprising:

an injector body having an axially extending fuel passage for fuel flow therein;

an injection valve movable in the passage for controlling fuel flow;

a valve seat adjustably positioned into an outlet end of the fuel passage; and a valve seat retainer for applying an axial load onto and securely attaching the valve seat into the fuel passage of the injector body;

wherein the valve seat retainer is defined as a circular channel member having an inner wall and an outer wall, where the outer wall further includes an offshoot which protrudes outward and axially above the inner wall.

11. The fuel injector of claim 10 wherein the valve seat retainer is pressed into the valve seat, such that the top of the inner wall engages the bottom surface of the valve seat, thereby applying an axial load onto the valve seat, and is retained in position by crimping the offshoot of the valve seat retainer over an outwardly extending flange of the injector body.

12. The fuel injector of claim 11 wherein the inner wall deflects under a predetermined axial force, thereby maintaining the axial load on the valve seat.

13. The fuel injector of claim 10, wherein the valve seat retainer is a hollow cylinder pressed against a bottom surface of the valve seat, thereby applying an axial load onto the valve seat, and attached to the injector body by a weld positioned between the outer surface of the cylinder and the inner surface of the injector body.

14. The fuel injector of claim 13 wherein an upper corrugated portion of the cylinder deflects under a predetermined axial force, thereby maintaining the axial load on the valve seat.

15. The fuel injector of claim 10, wherein the valve seat retainer is a cup-shaped member, having an opening therethrough, pressed against a bottom surface of the valve seat, thereby applying an axial load onto the valve seat, and attached to the injector body by a weld positioned between the outer surface of the cup-shaped member and the inner surface of the injector body.

16. The fuel injector of claim 15 wherein the opening in the bottom surface of the cup-shaped member forms a radially inwardly extending lip, such that the lip deflects under a predetermined axial force, thereby maintaining the axial load on the valve seat.

17. The fuel injector of claim 10, further comprising.

a director with multiple openings for directing fuel spray delivery from the injector, wherein the director is adapted to engage a bottom surface of the valve seat; and a director retainer pressed against a bottom surface of the valve seat, thereby retaining the director onto the valve seat, and attached to the injector body by a weld positioned between the outer surface of the director retainer and the inner surface of the valve seat member.

18. The fuel injector of claim 10, wherein the valve seat retainer includes a load means for applying an axial force onto a bottom surface of the valve seat and a connector means for attaching the valve seat into the injector body.

19. A method for attaching a valve seat assembly into an injector body of a fuel injector, the injector body having an axially extending fuel passage therein, comprising the steps of:

adjustably positioning the valve seat assembly into an outlet end of the fuel passage;

applying an axial force onto a bottom surface of the valve seat assembly; and attaching the valve seat assembly into the fuel passage of the injector body, whereby the axial force is substantially retained on the bottom surface of the valve seat assembly;

wherein the step of applying an axial force comprises:

providing a valve seat retainer for attaching the valve seat assembly, wherein the valve seat retainer is further defined as a circular channel member having an inner wall and an outer wall, where the outer wall further includes an offshoot which protrudes outward and axially upward above the inner wall; and pressing the valve seat retainer against the valve seat assembly, such that the top of the inner wall engages a bottom surface of the valve seat, thereby applying an axial force onto the valve seat.

20. The method of claim 19 wherein the step of attaching the valve seat assembly further comprises crimping the offshoot of the valve seat retainer over an outwardly extending flange of the injector body.

21. A method for attaching a valve seat assembly into an injector body of a fuel injector, the injector body having an axially extending fuel passage therein, comprising the steps of:

adjustably positioning the valve seat assembly into an outlet end of the fuel passage;

applying an axial force onto a bottom surface of the valve seat assembly; and attaching the valve seat assembly into the fuel passage of the injector body, whereby the axial force is substantially retained on the bottom surface of the valve seat assembly;

wherein the step of applying an axial force comprises:

providing a valve seat retainer for attaching the valve seat assembly, wherein the valve seat retainer is defined as either a hollow cylinder or a cup-shaped member having an opening therethrough; and pressing the valve seat retainer against a bottom surface of the valve seat assembly, thereby applying an axial force onto the valve seat assembly.

22. The method of claim 21, wherein the step of attaching the valve seat assembly further comprises welding the outer surface of the valve seat retainer to the inner surface of the injector body.

* * * * *